US009825383B2

(12) United States Patent
Xiao et al.

(10) Patent No.: US 9,825,383 B2
(45) Date of Patent: Nov. 21, 2017

(54) SHIELDED CIRCUIT BOARD MOUNTED CONNECTOR HAVING BLADE TYPE CONTACTS

(71) Applicant: FOXCONN INTERCONNECT TECHNOLOGY LIMITED, Grand Cayman (KY)

(72) Inventors: Xue-Yuan Xiao, Kunshan (CN); Zi-Qiang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/140,423

(22) Filed: Apr. 27, 2016

(65) Prior Publication Data

US 2016/0315406 A1 Oct. 27, 2016

(30) Foreign Application Priority Data

Apr. 27, 2015 (CN) ..... 2015 2 0256835 U
Apr. 27, 2015 (CN) ..... 2015 2 0256857 U

(51) Int. Cl.
*H01R 13/648* (2006.01)
*H01R 12/71* (2011.01)
(Continued)

(52) U.S. Cl.
CPC ..... *H01R 12/716* (2013.01); *H01R 12/707* (2013.01); *H01R 13/113* (2013.01)

(58) Field of Classification Search
CPC H01R 13/6581; H01R 13/113; H01R 13/114; H01R 13/115; H01R 13/20; H01R 43/0256
(Continued)

(56) References Cited

U.S. PATENT DOCUMENTS 5,399,108 A * 3/1995 Lu ..... H05K 7/1084 439/682
5,559,676 A * 9/1996 Gessaman ..... H05K 1/141 174/377
(Continued)

FOREIGN PATENT DOCUMENTS

TW 452258 6/2000

*Primary Examiner* — Amy Cohen Johnson
*Assistant Examiner* — Milagros Jeancharles
(74) *Attorney, Agent, or Firm* — Wei Te Chung; Ming Chieh Chang

(57) ABSTRACT

A connector (100) comprises an insulative housing (1) and a plurality of contacts (2) assembled onto the insulative housing (1), the insulative housing (1) defining a mating surface (11), a mounting surface (12) opposite to the mating surface (11) and a plurality of contact grooves (13) passing though the mating surface (11) and the mounting surface (12). The contact (2) assembled onto the insulative housing (1) from the mounting surface (12) of the insulative housing (1), each contact (2) including a contact portion (21) received in the contact grooves (13) and a mounting portion (22) extending out of the insulative housing (1). Wherein the connector (100) further includes a shell (4) assembled to the insulative housing (1), the shell (4) includes a shielding portion (41) shielding the mounting surface (12), thereby preventing the contact (2) shedding from the insulative housing (1) or loosening in the insulative housing (1) to make the combine of the contact (2) and insulative housing (1) reliable.

18 Claims, 11 Drawing Sheets

(51) Int. Cl.
*H01R 12/70* (2011.01)
*H01R 13/11* (2006.01)

(58) Field of Classification Search
USPC .... 439/733.1, 682, 862, 876, 476, 855–857, 439/476.1, 552–558, 607.36, 55–83, 668, 439/669
See application file for complete search history.

(56) References Cited

U.S. PATENT DOCUMENTS 5,860,838 A * 1/1999 Kaneko ..... H01R 13/112 439/857
5,919,051 A * 7/1999 Mitra ..... H01R 12/716 439/74
6,095,865 A * 8/2000 Wu ..... H01R 23/6873 439/607.01
6,276,966 B1 * 8/2001 Yamoto ..... H01R 13/65802 439/607.13
6,287,130 B1 * 9/2001 Torii ..... H01R 12/707 439/83
6,338,634 B1 * 1/2002 Yu ..... H01R 4/028 439/83
6,364,706 B1 * 4/2002 Ando ..... H01R 23/6873 439/607.37
6,450,837 B1 * 9/2002 Givens ..... H01R 13/65802 439/607.28
7,052,289 B1 * 5/2006 Hao ..... H01R 12/57 439/83
7,059,886 B2 * 6/2006 Ju ..... H01R 13/193 439/342
7,150,652 B1 * 12/2006 Jeon ..... H01R 13/6658 439/607.13
7,429,192 B2 * 9/2008 Liao ..... H01R 13/6594 439/567
7,497,700 B2 * 3/2009 Chen ..... H01R 12/57 439/78
8,100,703 B2 * 1/2012 Chen ..... H01R 12/716 439/83
8,435,077 B2 * 5/2013 Yang ..... H01R 12/721 439/637
8,821,191 B2 * 9/2014 Soo ..... H01R 12/55 439/630
9,065,228 B2 * 6/2015 Nishimura ..... H01R 12/79
9,112,311 B2 * 8/2015 Asai ..... H01R 13/658
9,407,020 B2 * 8/2016 Gao ..... H01R 12/7082
2001/0014554 A1 * 8/2001 Yoshimura ..... H01R 13/2442 439/607.22
2006/0258192 A1 * 11/2006 Yi ..... H01R 13/112 439/83
2006/0258200 A1 * 11/2006 Hao ..... H01R 12/57 439/342
2008/0299813 A1 * 12/2008 Dawiedczyk ..... H01R 13/6275 439/357
2011/0059634 A1 * 3/2011 Chen ..... H01R 12/716 439/83
2014/0357121 A1 * 12/2014 Chang ..... H01R 13/6585 439/607.01

* cited by examiner

SHIELDED CIRCUIT BOARD MOUNTED CONNECTOR HAVING BLADE TYPE CONTACTS

BACKGROUND OF THE INVENTION

1. Field of the Invention

The present invention relates to a connector and assembly of the same, particularly to a connector and assembly of the same comprising a shell. This application relates to the copending application, application Ser. No. 15/140,428, filed on the same date, having the same inventors, the same assignee and the same applicant; and titled with LOW PROFILE CONNECTOR AND ASSEMBLY OF THE SAME.

2. Description of Related Art

A connector disclosed in Taiwan Patent No. TW 452258, issued on Aug. 21, 2001, is a related connector. The connector can be assembled on printed circuit board, which comprises an insulative housing extending along a length direction and a plurality of contacts assembled onto the insulative housing, the insulative housing defining a mating surface mating with a mating member, a mounting surface opposite to the mating surface and contact grooves passing though the mating surface and the mounting surface, each contact including a contact portion received in contact grooves and a mounting portion extending out of the insulative housing. However, as the contact upwardly assembles in the insulative housing from the mounting surface of the insulative housing, and the mounting surface of the insulative housing not have any other elements to shield the contacts, thus, the contact is easy to fall off or loose from the mounting surface of the insulative housing during the process of transporting or mounting to the circuit board.

Hence, a new and simple connector and assembly of the same is desired.

SUMMARY OF THE INVENTION

According to one aspect of the present invention, a connector comprises an insulative housing and a plurality of contacts assembled onto the insulative housing, the insulative housing defining a mating surface, a mounting surface opposite to the mating surface and a plurality of contact grooves passing though the mating surface and the mounting surface. The contact assembled onto the insulative housing from the mounting surface of the insulative housing, each contact including a contact portion received in the contact grooves and a mounting portion extending out of the insulative housing. Wherein the connector further includes a shell assembled to the insulative housing, the shell includes a shielding portion shielding the mounting surface, thereby preventing the contact shedding from the insulative housing or loosening in the insulative housing to make the combine of the contact and insulative housing reliable. Therefore, as the contact of the present invention assembled in insulative housing from the mounting surface of the insulative housing, the shielding portion of the shell shields the mounting surface of the insulative housing, thereby preventing the contacts shedding from the insulative housing or loosening in the insulative housing to make the combine of the contact and insulative housing reliable.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

FIG. 10 is another perspective view of FIG. 9.

DETAILED DESCRIPTION OF THE PREFERRED EMBODIMENT

Figure 1:
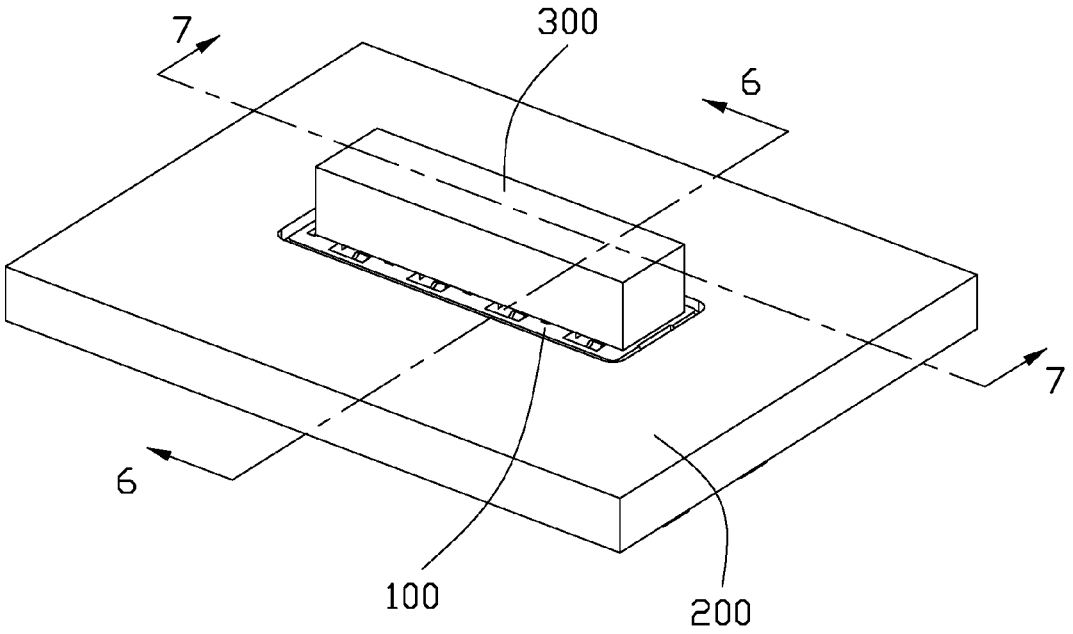
FIG. 1 is a perspective view of the cooperating of connector, printed circuit board and stepper motor of the first embodiment.
Figure 2:
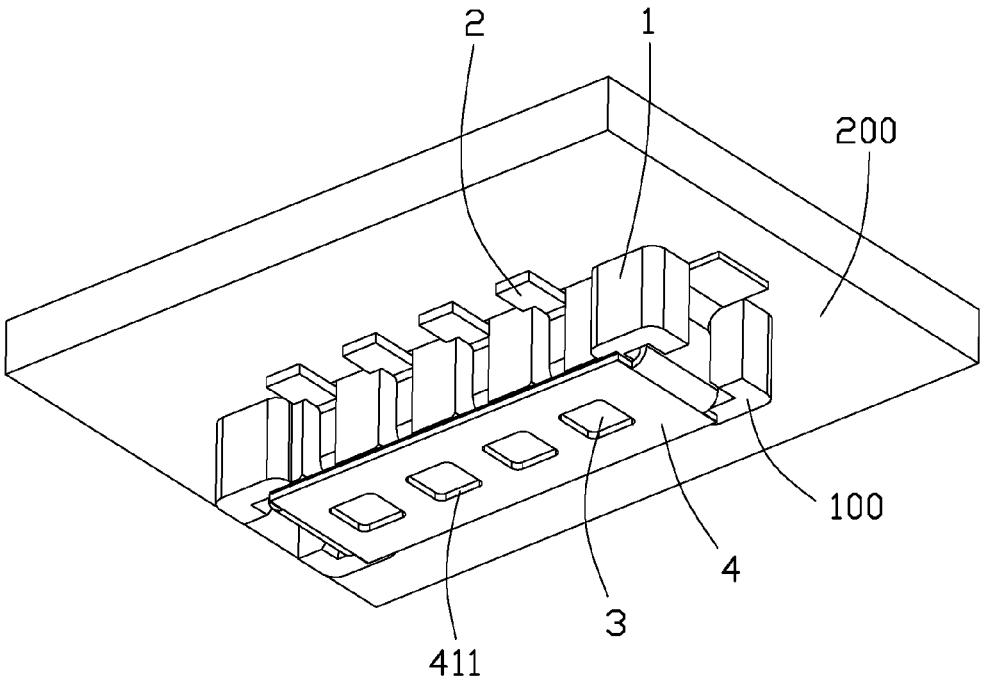
FIG. 2 is another perspective view of FIG. 1.
Figure 3:
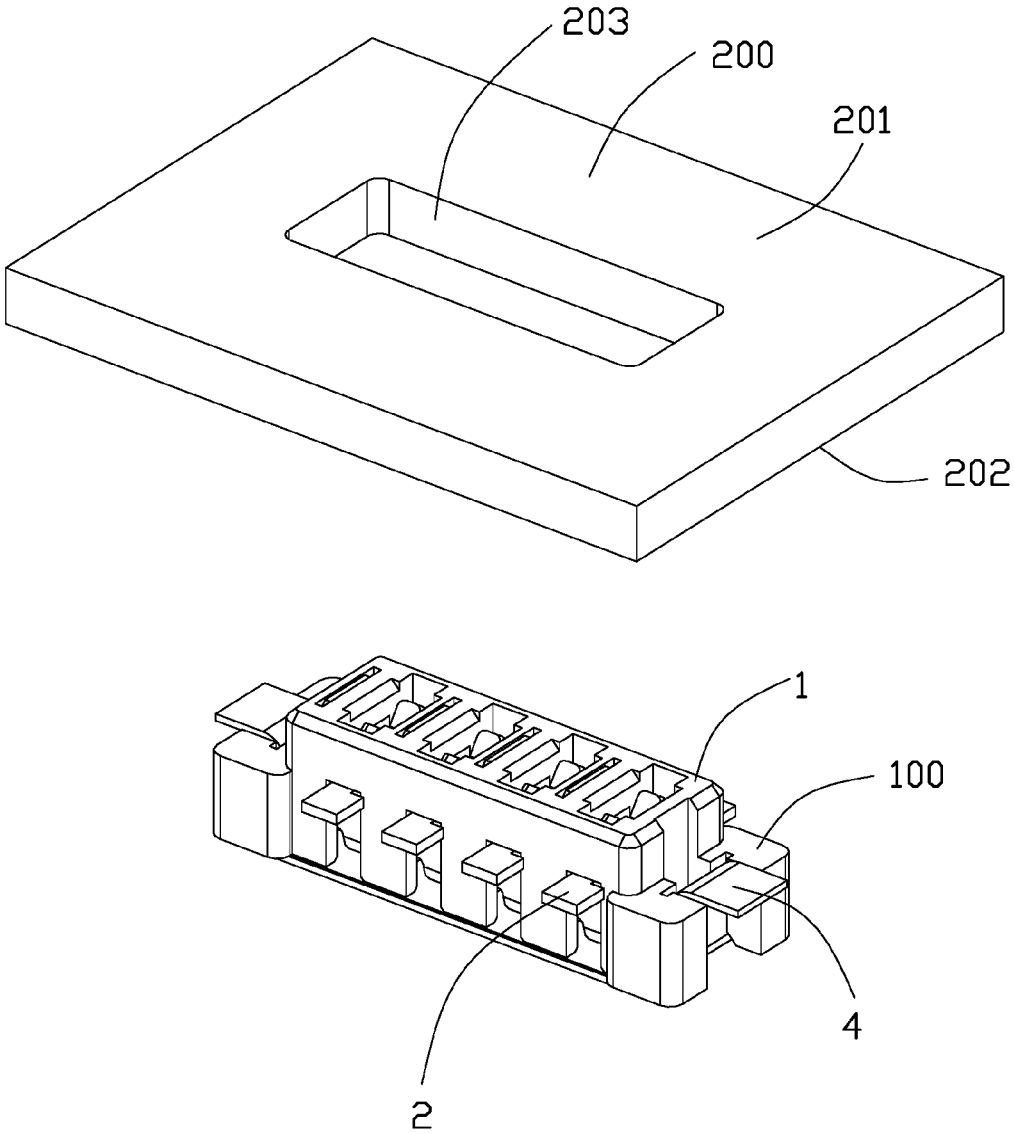
FIG. 3 is a perspective view of the separation after the connector and the printed circuit board of FIG. 1.
Figure 4:
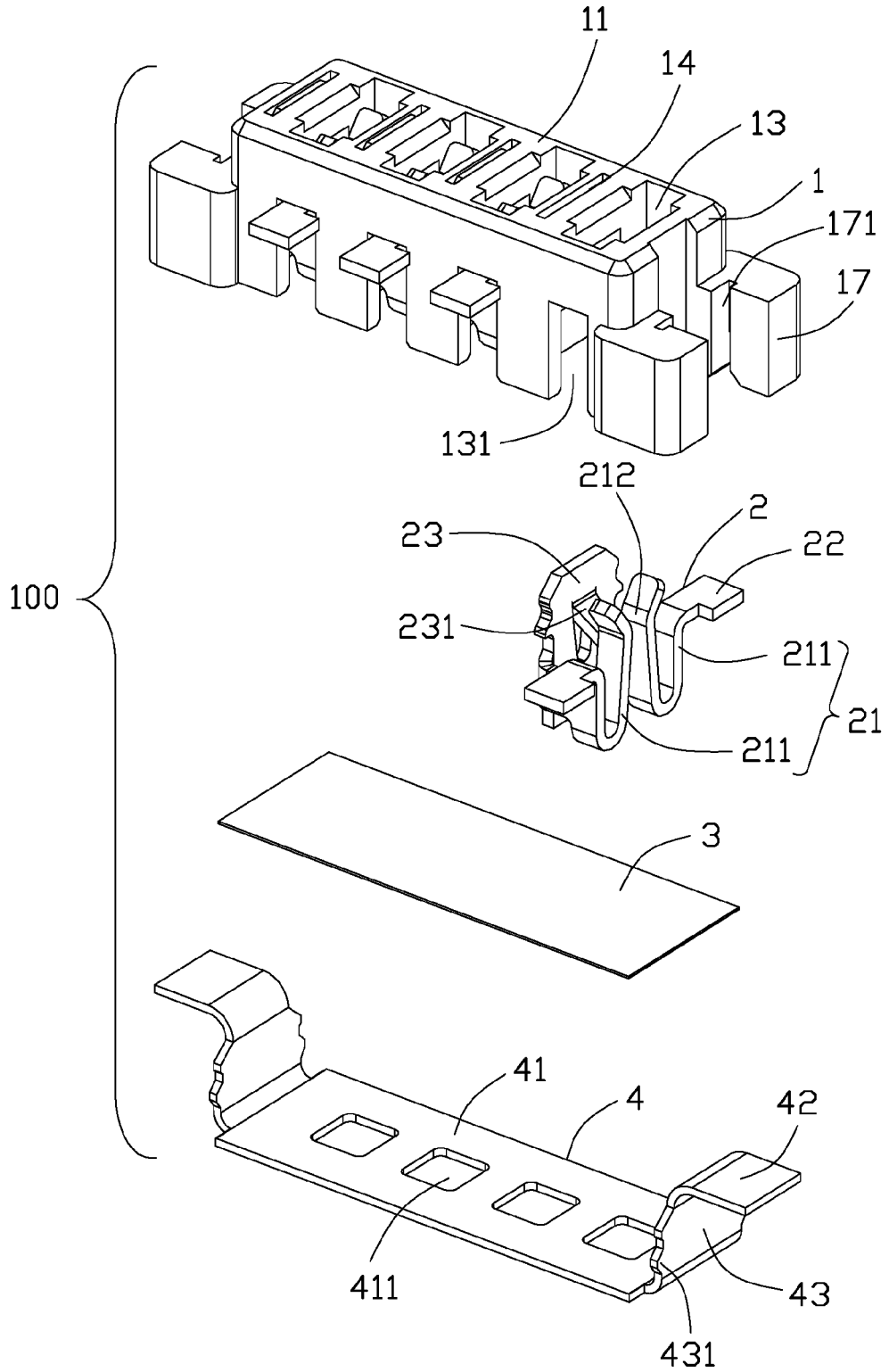
FIG. 4 FIG. 10 is a partial exploded, perspective view of FIG. 3.
Figure 5:
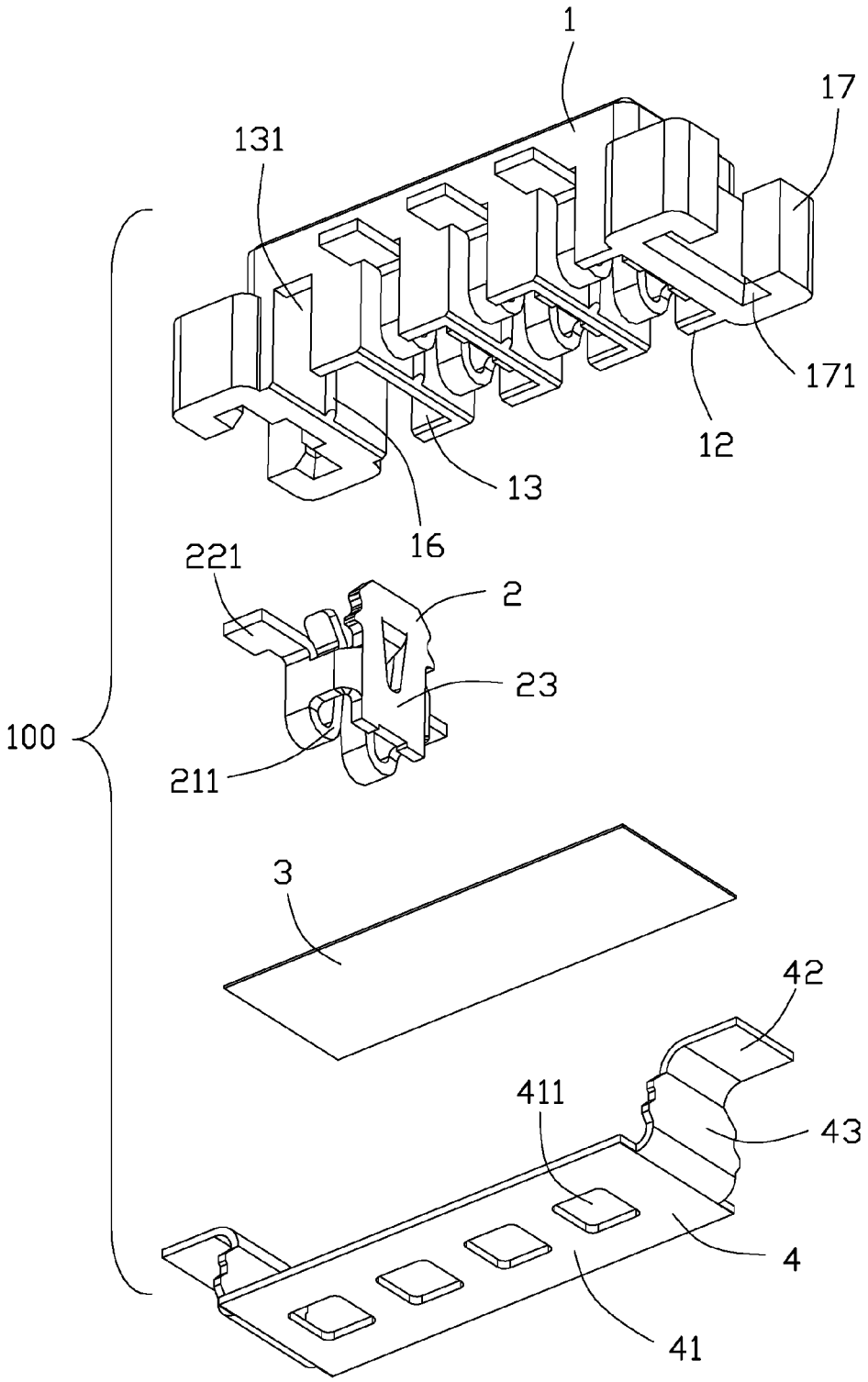
FIG. 5 is another perspective view of FIG. 4.

Reference will now be made in detail to the preferred embodiment of the present invention. Referring to FIGS. 1-5, the first embodiment of the present invention discloses a connector 100 for assembling to the printed circuit board 200 and making an mating element insert thereby forming electrical connection each other, the mating element/component is a portion of stepper motor 300 in this embodiment.

The printed circuit board 200 includes an upper/first surface 201, a lower/second surface 202 and a through opening 203 penetrating said upper surface 201 and lower surface 202. In present embodiment, the opening 203 is closed/surrounded and located at the middle position of the printed circuit board 200; in other embodiments, the opening 203 can also be open and located at the edge of the printed circuit board 200.

Figure 6:
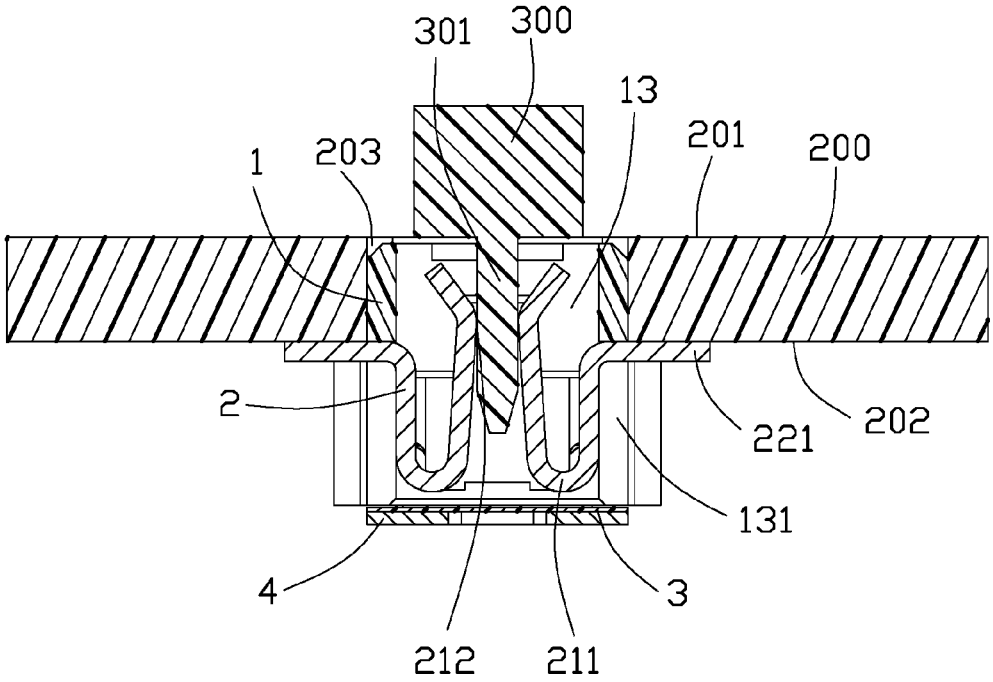
FIG. 6 is a cross sectional view shown in FIG. 1 along line 6-6.
Figure 7:
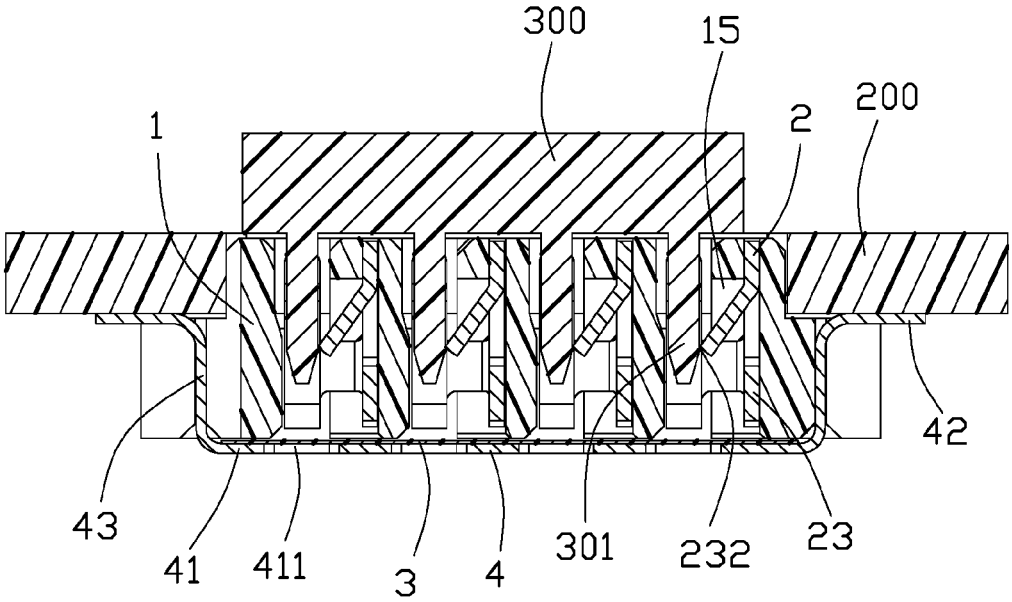
FIG. 7 is a cross sectional view shown in FIG. 1 along line 7-7.

Referring to FIGS. 1-7, the connector 100 is upwardly assembled to an opening 203 of the printed circuit board 200 from the lower surface 202 of the printed circuit board 200 and comprises an insulative housing 1 received in the opening 203, a plurality of contacts 2 mating with the stepper motor 300, a shell 4 assembling to the insulative housing 1 and a transparent insulative film 3 disposed between the insulative housing 1 and shell 4.

The insulative housing 1 extends along the longitudinal direction and defines a mating surface 11 locating at upside, a mounting surface 12 locating at downside and a plurality of contact grooves 13 passing though the mating surface 11 and the mounting surface 12 to enclose the inserting portion 301 of the stepper motor 300. The mating surface 11 of the insulative housing 1 exposes to the upside of the printed circuit board 200, and the mounting surface 12 exposes to the downside of the printed circuit board 200. The contact grooves 13 arranged along the longitudinal direction of the insulative housing 1, and each contact groove 13 further defines a notch 131 passing though the mounting surface 12 and insulative housing 1. The insulative housing 1 also defines positioning grooves 14 penetrating the upside and downside of the insulative housing 1 and a plurality of slots 15 each located between the positioning groove 14 and contact groove 13 and linking the positioning groove 14 and contact groove 13.

Each contact 2 is upwardly assembled to the insulative housing 1 from the mounting surface 12 of the insulative housing 1, and comprises a contact portion 21 received in the contact grooves 13 of insulative housing 1 and a mounting portion 22 extending out of the insulative housing 1. The contact portion 21 includes a pair of clamping portions 211 received in the contact grooves 13, the clamping portion 211 protruding in contact grooves 13 along a transverse vertical to the longitudinal direction to clamp the inserting portion 301 of the stepper motor 300, thereby keeping the stepper motor 300 better in the connector 100. Each contact 2 includes a connecting portion 23 connecting two clamping portions 211 and an elastic resisting portion 231 protruding in the contact grooves 13. The elastic resisting portion 231 locates between the two clamping portions 211, the elastic resisting portion 231 extending or stamping molding from the connecting portion 23 and leaning against the inserting portion 301 of the stepper motor 300. The clamping portion 211 defines a first contact point 212 which is relatively closer to interfere with inserting portion 301 so as to enhance the clamping force of the clamping portion 211, the elastic resisting portion 231 defines a second contact point 232 locates between the respective clamping portion 211, the first contact point 212 is closer to the mating surface 11 of the insulative housing 1 than the second contact point 232, and the first contact point 212 disposed at the upside of the notch 131 upon an up-to-down direction, therefore, the time when the inserting portion 301 of the stepper motor 300 inserting, the insulative housing 1 could prevent the first contact point 212 from excessive deformation while said first contact point 212 forms elastic deformation toward to two sides. The second contact point 232 locates at the notch 131 upon an up-to-down direction. The mounting portion 22 includes a pair of mounting tails 221 horizontally extending from two opposite sides of two clamping portion 211, the mounting tail 221 extending outside of the insulative housing 1 from the notch 131, said mounting tails 221 assembled to the lower surface 202 of the printed circuit board 200 by the means of Surface Mount Technology (SMT). The insulative housing 1 defines a plurality of ribs 16 protruding in the contact grooves 13 and located between respective clamping portion 211, the ribs 16 located at the downside of the first contact point 211 and located at the notch 131 upon an up-to-down direction, thus, after the stepper motor 300 inserting the connector 100, the inserting portion 301 clamps between the rib 16 and elastic resisting portion 231 along the longitudinal direction by the elastic leaning against effect of the elastic resisting portion 231. The shielding portion 41 defines a plurality of windows 411 opposite to the contact grooves 13 and could observe the contact portion 21 of contact grooves 13 from outside.

The present invention with the contact portion 21 of contact 2 includes a pair of clamping portions 211 to clamp the stepper motor 300 (mating member) inserting, thereby limiting the inserting portion 301 of the stepper motor 300 move along the transverse, at the same time, the elastic resisting portion 231 protruding between respective clamping portion 211 and leaning against the inserting portion 301 in the longitudinal direction to limit the inserting portion 301 of the stepper motor 300 move along the longitudinal direction, therefore making the stepper motor 300 held more reliably in the contact groove 13, to ensure that the stepper motor 300 mating reliably with the connector 100.

Due to the first contact point 212 of the clamping portion 211 is closer to the mating surface 11 of the insulative housing 1 than the second contact point 232 of the elastic resisting portion 231, during the process of the stepper motor 300 inserts in the connector 100, the inserting portion 301 fixed and clamped by the clamping portion 211 at first, then leaning against by the elastic resisting portion 231 for fear that the time when the inserting portion 301 inserting, the inserting portion 301 simultaneously coordinating with the clamping portion 211 and elastic resisting portion 231, thereby not only reducing the inserting and pulling up force of the stepper motor 300, but also ensuring that the stepper motor 300 smoothly to insert in.

After the stepper motor 300 inserting in the connector 100, the inserting portion 300 not only held between respective clamping portion 211 along the transverse, but also clamped between the elastic resisting portion 231 and the rib 16 of the insulative housing 1 along the longitudinal direction by the elastic leaning against effect of the elastic resisting portion 231, thereby ensuring that the inserting portion 301 can be fixed at the contact grooves 13 along any directions.

The shell 4 is made of a metal material and includes a shielding portion 41 shielding the mounting surface 12 of the insulative housing 1, a pair of retaining portions 43 extending vertically from the two sides of the shielding portion 41 for being retained in the insulative housing 1 and a pair of soldering tails 42 further extending horizontally from the respective retaining portions 43, and the soldering tail 42 is parallel to the shielding portion 41. The mounting tail 221 is in the same horizontal surface with the soldering tail 42. The insulative housing 1 defines protruding portions 17 protruding at two sides thereof along a longitudinal direction to lean against the lower surface 202 of the printed circuit board 200, the protruding portion 17 defines a locking groove 171 for securing the retaining portion. The soldering tail 42 extends outwardly beyond the protruding portion 17 along the longitudinal direction to assemble to the lower surface 202 of the printed circuit board 200. Each retaining portion 43 defines a plurality of convexes 431 formed at two sides thereof and interfered with the locking groove 171 along two sides of the transverse, thereby making the shell 4 more reliably fixed on the insulative housing 1.

The transparent insulative film 3 located between the shielding portion 41 and the mounting surface 12 to isolate the contact 2 and shell 4 for fear that the shell 4 made of a metal material contacting with the contact 2, the insulative film 3 may be a polyester film, also other various kinds of insulative materials. The shielding portion 41 defines a plurality of windows 411 opposite to the contact grooves 13 and could observe the contact portion 21 of contact grooves 13 from outside, thus conveniently observing the situation combined of the inserting portion 301 and the contact portion 21 after the stepping motor 300 inserting, to ensure the mating of the stepper motor 300 and the connector 100 more reliable.

As the contact 2 of the present invention assembled to insulative housing 1 from the mounting surface 12 of the insulative housing 1, the shielding portion 41 of the shell 4 shields the mounting surface 12 of the insulative housing 1, thereby preventing the contacts 2 shedding from the insulative housing 1 or loosening in the insulative housing 1 in the process of transportation or assembling, to make the combine of the contact 2 and insulative housing 1 reliable. The shell 4 is fixed in the locking groove 171 of the insulative housing 1 by the retaining portion 43 and soldered to the lower surface 202 of the printed circuit board 200 by the soldering tail 42, thereby making the connector 100 better fixed at the printed circuit board 200 and the structural strength of the connector 100 greatly enhanced.

The shielding portion 41 defines a plurality of windows 411 opposite to the contact grooves 13, and the insulative film 3 located between the shielding portion 41 and the mounting surface 12 is transparent, thus the user conveniently observing the situation combined of inserting portion 301 in the contact grooves 13 and contact portion 21 from outside, to ensure the mating of the stepper motor 300 and the connector 100 reliable.

Figure 8:
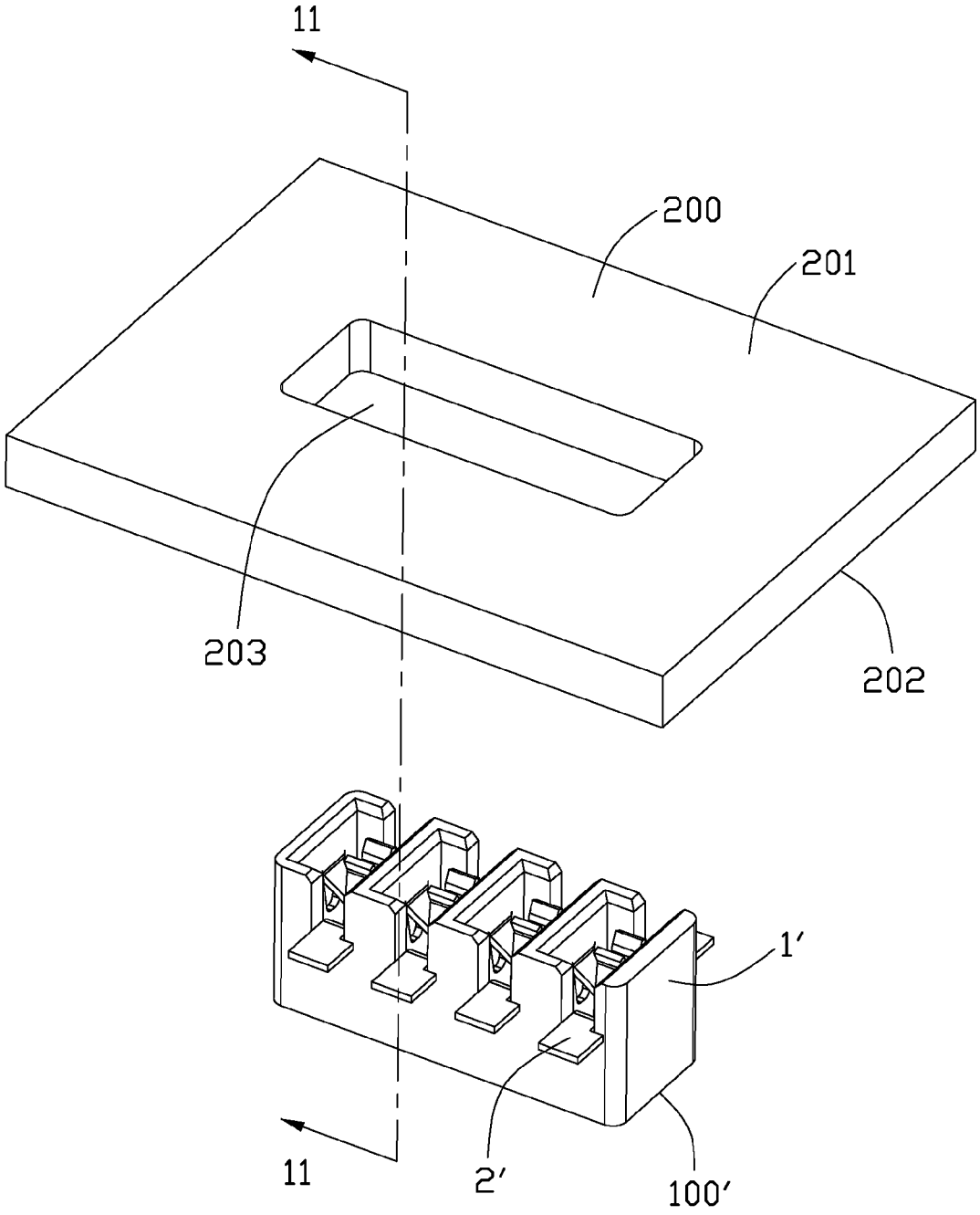
FIG. 8 is a perspective view of the separation after the connector and the printed circuit board of the second embodiment.
Figure 9:
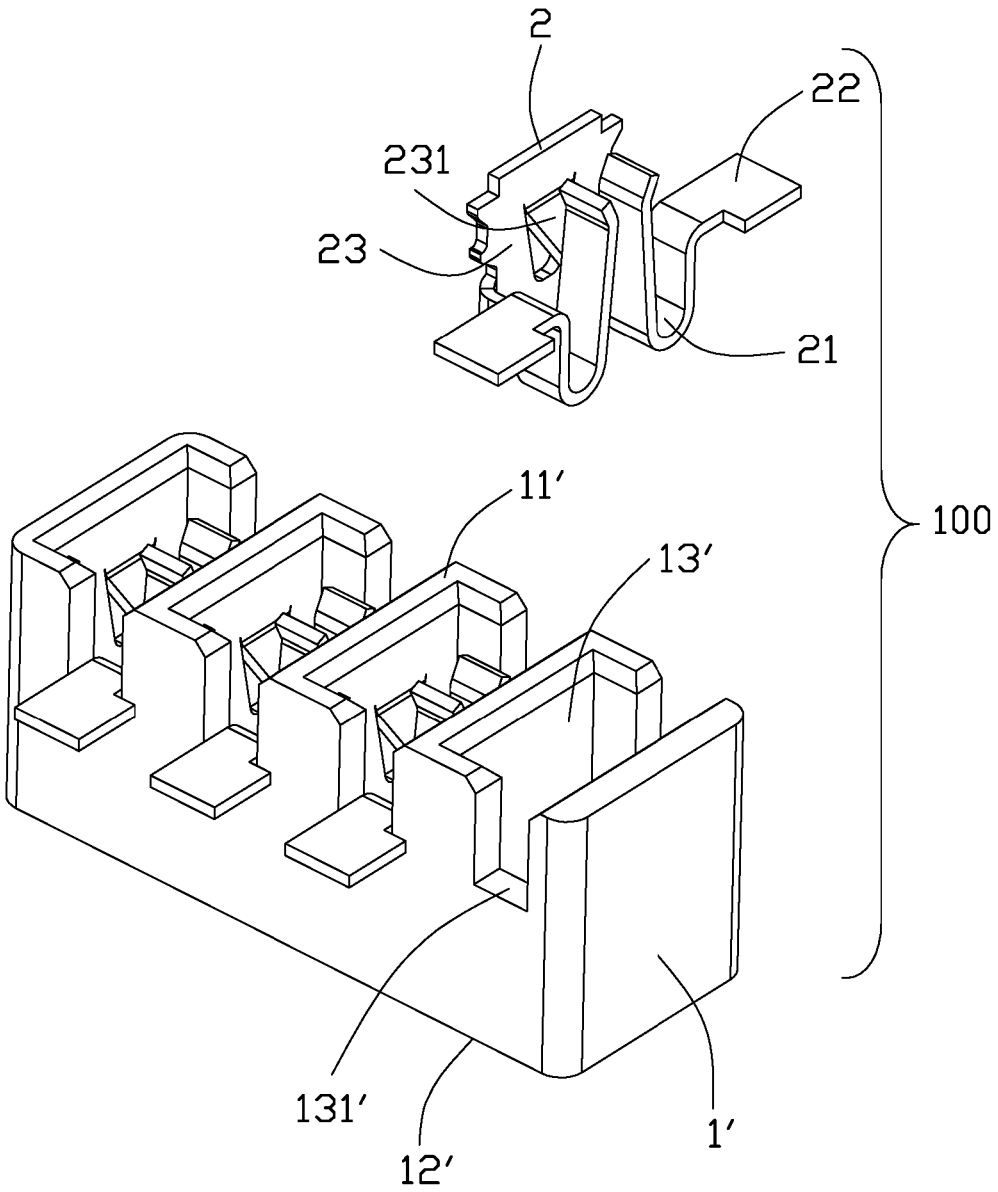
FIG. 9 is a partial exploded, perspective view of FIG. 8.
Figure 10:
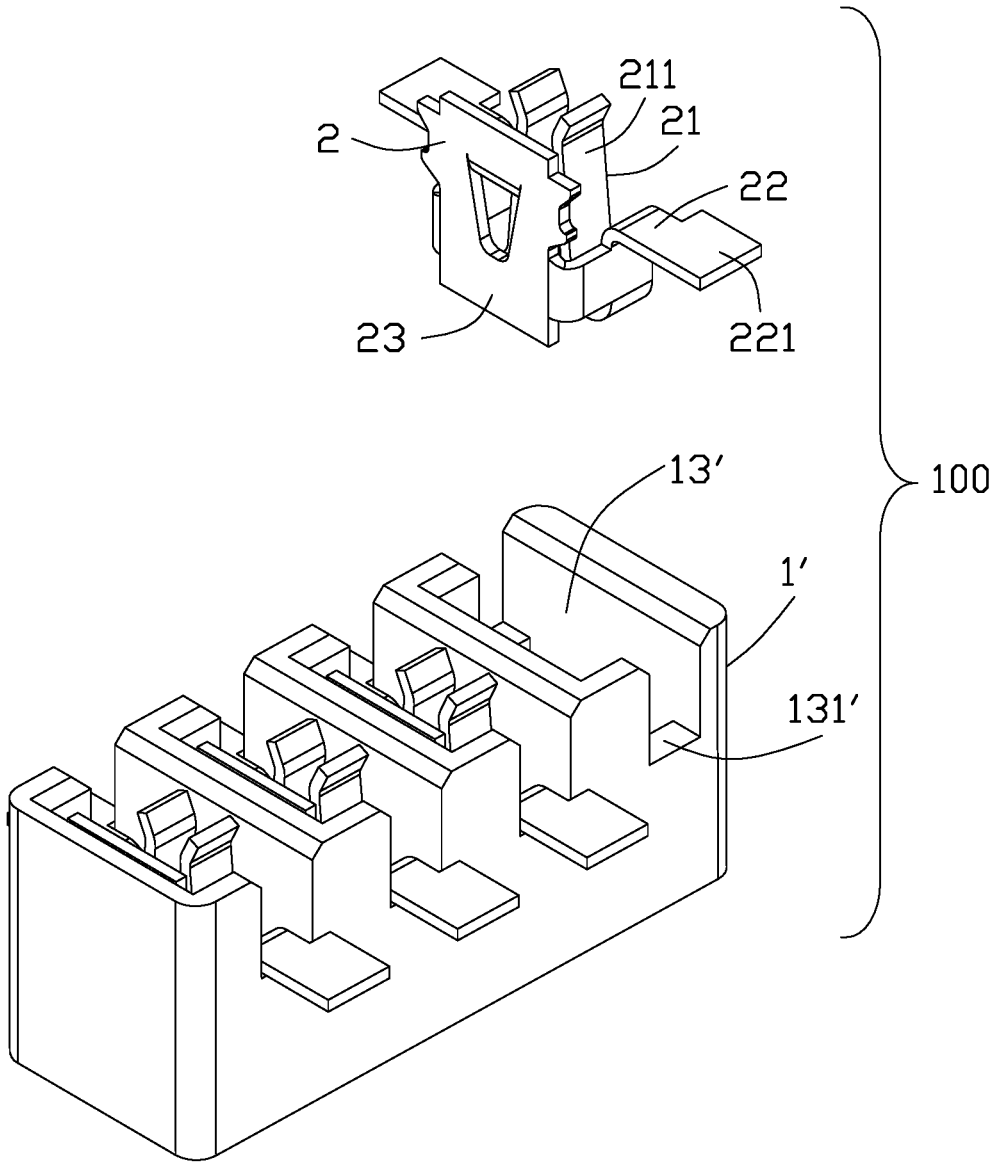
Figure 11:
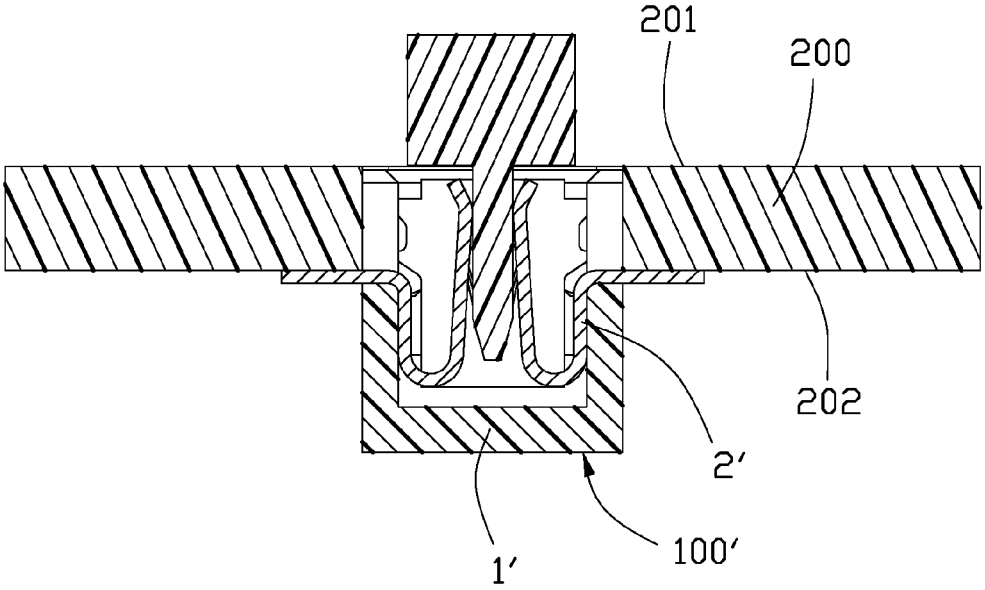
FIG. 11 is a cross sectional view shown in FIG. 8 along line 7-7 when the connector is mounted upon the printed circuit board.

Referring to FIGS. 8-11, the second embodiment of the instant invention discloses a connector 100, what the slightly different with the first embodiment is the structure of the insulative housing 1' and not have the shell 4, so applicant will only detail address the difference of the insulative housing 1'. In the second embodiment, the mounting surface 12' of the insulative housing 1' is closed without the viewing openings disclosed in the housing of the first embodiment, thus, it is no necessary to set an insulative film 3 and a shell 4, in other embodiments, at the basics of the second embodiment, the connector 100 also could add a shell 4 including a shielding portion 41 shielding the mounting surface 12' assembled to the insulative housing 1', but the effect of adding another shell 4 is to enhance the strength of the connector 100. In the second embodiment, the notch 131' upwardly penetrates the insulative housing 1' and transversely extends through the insulative housing 1' toward outside, the contact 2 downwardly assembling to the insulative housing 1' from the mating surface 11' of the insulative housing 1', the insulative housing 1' does not define the structure of ribs 16', after the inserting portion 301 of the stepper motor 300 inserting the connector 100, the inserting portion 300 clamped between the elastic resisting portion 231 and the insulative housing 1' along the longitudinal direction by the elastic leaning against effect of the elastic resisting portion 231.

In brief, the instant invention is to provide a printed circuit board with two opposite first and second surfaces in the vertical direction, and an insulative housing with two opposite first and second faces in the vertical direction, and first and second portions between the first portion and the second portion in the vertical direction, wherein the first portion is received within a through opening of the printed circuit board with the first face adjacent to the first surface where the mating port of the connector is located, and the second portion, where the viewing openings of the housing and the window of the shell are located, is exposed around the second surface. Each contact includes a pair of mounting portions exposed outside of the housing in the transverse direction, and a pair of clamping portions extending from the corresponding pair of mounting portions, respectively, Each clamping portion forms a U-shaped configuration with an outer arm linked to the corresponding mounting portion, an inner arm disposed in the mating port with a deflected end section around the first face for guiding insertion of the mating component, and a bight linked between the inner arm and the outer arm and located around the second face. Notably, the contact loading direction in the first embodiment is opposite to that in the second embodiment even though the U-shaped configuration extends in the same orientation in both embodiments.

While a preferred embodiment of the present invention has been shown and described, equivalent modifications and changes known to persons skilled in the art according to the spirit of the present invention are considered within the scope of the present invention as described in the appended claims.

What is claimed is:

1. A connector comprising:

an insulative housing defining a mating surface, a mounting surface opposite to the mating surface and a plurality of contact grooves passing through the mating surface and the mounting surface;

a plurality of contacts assembled onto the insulative housing from the mounting surface of the insulative housing, each contact including a contact portion received in the contact groove and a mounting portion extending out of the insulative housing, each contact portion includes a pair of clamping portions received in the contact groove;

wherein the connector further includes a shell assembled to the insulative housing, the shell includes a shielding portion shielding the mounting surface, wherein the insulative housing defines a plurality of ribs protruding in the contact grooves and located between respective clamping portions.

2. The connector as claimed in claim 1, wherein the shell defines a pair of retaining portions extending vertically from two sides of the shielding portion for being retained in the insulative housing and a pair of soldering tails extending horizontally from the respective retaining portions, and the soldering tail is parallel to the shielding portion.

3. The connector as claimed in claim 2, wherein the insulative housing defines a pair of protruding portions protruding at two sides thereof, the protruding portion defines a locking groove for securing the retaining portion, each retaining portion defines a plurality of convexes formed at two sides thereof and interfered with the locking groove, and the soldering tail extends outwardly beyond the protruding portion.

4. The connector as claimed in claim 3, wherein the mounting portion includes a pair of mounting tails horizontally extending from the respective clamping portions, each the contact groove defines a pair of notches passing through the mounting surface and two sides of the insulative housing, the mounting tail extends outside of the insulative housing from the notch and locates at a same level with the soldering tail.

5. The connector as claimed in claim 4, wherein the connector includes a transparent insulative film disposed between the mounting surface of the insulative housing and the shielding portion of the shell.

6. The connector as claimed in claim 1, wherein the shielding portion defines a plurality of windows corresponding to the contact grooves for exposing the respective contact portions.

7. A connector comprising:

an insulative housing defining a mating surface and a set of contact grooves recessed from the mating surface;

a plurality of contacts retained in the insulative housing, each contact including a contact portion received in the contact groove and a mounting portion extending out of the insulative housing;

wherein the contact portion includes a pair of clamping portions protruding into the contact groove, and an elastic resisting portion protruding between the two clamping portions; wherein the clamping portion defines a first contact point; wherein the insulative housing defines a plurality of ribs protruding in the contact grooves and located between respective clamping portions, the ribs and the elastic resisting portion located under the first contact point along an up-to-down direction.

8. The connector as claimed in claim 7, wherein the contact includes a connecting portion connecting two clamping portions, the elastic resisting portion protruding and formed from the connecting portion.

9. The connector as claimed in claim 8, wherein the insulative housing defines positioning grooves enclosing the connecting portion and a plurality of slots located between the positioning groove and contact groove and linking the positioning groove and contact groove.

10. The connector as claimed in claim 7, wherein the elastic resisting portion defines a second contact point located between the respective clamping portion, the first contact point is closer to the mating surface of the insulative housing than the second contact point.

11. An electrical connector assembly comprising:

a printed circuit board defining opposite first and second surfaces in a vertical direction with an opening extending therethrough in said vertical direction;

an electrical connector including:

an insulative housing defining opposite first and second faces in said vertical direction, said first face located adjacent to the first surface and far from the second surface, and having a first portion extending from the first face toward the second face and received within the opening, and a second portion extending from the second face toward the first face and exposed around the second surface, said first portion defining a mating port exposed to an exterior around said first face in said vertical direction;

a plurality of contacts respectively disposed in a plurality of contact grooves, each of said contacts including a pair of mounting portions exposed and extending outwardly and transversely out of the housing in a transverse direction perpendicular to said vertical direction and seated upon the second surface, a pair of clamping portions respectively extending from the corresponding mounting portions, each of said clamping portions having a U-shaped configuration with an opening facing to said exterior in the vertical direction regulated from the second surface to the first surface; wherein said U-shaped configuration defines an outer arm linked to the corresponding mounting portion, an inner arm spaced from the outer arm and extending in the mating port for contacting an mating component, and a bight linked between the outer arm and the inner arm and located around the second face; wherein each of said contacts includes a blade type connecting portion beside the pair of clamping portions and linked to the corresponding pair of mounting portions; wherein each of said blade type connecting portion further includes an elastic resisting portion to cooperate with the inner arms of the pair of clamping portions to form three-point engagement with the corresponding mating component.

12. The electrical connector assembly as claimed in claim 11, wherein the U-shaped configuration is viewed along a longitudinal direction perpendicular to said vertical direction.

13. The electrical connector assembly as claimed in claim 11, wherein said housing forms a plurality of notches that extend therethrough in said transverse direction, so as to receive the corresponding mounting portions, respectively.

14. The electrical connector assembly as claimed in claim 13, wherein said notch extends from the first face in the vertical direction so as to allow the contact to be assembled into the corresponding contact groove in the vertical direction from the first face toward the second face, or extends from the second face in the vertical direction so as to allow the contact to be assembled into the corresponding contact groove in the vertical direction from the second face toward the first face.

15. The electrical connector assembly as claimed in claim 11, wherein the second face of the housing forms corresponding viewing openings for viewing mating between the inner arm and the mating component from the second face.

16. The electrical connector assembly as claimed in claim 15, wherein a transparent film is applied upon said viewing openings for dustproof consideration.

17. The electrical connector assembly as claimed in claim 11, wherein said inner arm is longer than the outer arm with a deflected end section around the first face for guiding insertion of the mating component during mating.

18. The electrical connector assembly as claimed in claim 11, wherein each of said contact grooves is associated with a positioning groove to receive the corresponding connecting portion.

* * * * *